United States Patent [19]

Huber

[11] Patent Number: 4,659,963

[45] Date of Patent: Apr. 21, 1987

[54] GAS-DISCHARGE DISPLAY APPARATUS WITH A SPACER FRAME AND METHOD FOR FABRICATING THIS FRAME

[75] Inventor: Wilhelm Huber, Goldach, Fed. Rep. of Germany

[73] Assignee: Siemens Aktiengesellschaft, Berlin and Munich, Fed. Rep. of Germany

[21] Appl. No.: 636,915

[22] Filed: Aug. 2, 1984

[30] Foreign Application Priority Data

Aug. 3, 1983 [DE] Fed. Rep. of Germany ..... 3328036

[51] Int. Cl.[4] ..... H01J 17/49

[52] U.S. Cl. ..... 313/493; 313/485

[58] Field of Search ..... 313/485, 493, 634, 422

[56] References Cited

U.S. PATENT DOCUMENTS 4,362,967 12/1982 Littwin et al. ..... 313/493

FOREIGN PATENT DOCUMENTS 2647552 4/1977 Fed. Rep. of Germany ..... 313/634

*Primary Examiner*—David K. Moore

*Assistant Examiner*—K. Wieder

*Attorney, Agent, or Firm*—Herbert L. Lerner; Laurence A. Greenberg

[57] ABSTRACT

Gas discharge display device having a vacuum-tight gas-filled envelope with a front plate and a back plate. A perforated control unit divides the interior of the envelope into a gas discharge space and a post-acceleration space and includes several electrode planes extending parallel to the plates. The gas discharge space has at least one plasma cathode and at least one plasma anode. The front layer carries on its back side a cathodoluminescent layer as well as an electrically conducting layer (post-acceleration anode). A spacer frame spaces the conductor as post-acceleration cathode in the foremost electrode plane of the control unit from the post-acceleration anode. In operation, a gas discharge burns at least temporarily between the plasmas electrodes. Electrons are pulled through selectively opened holes of the control unit into the post-acceleration space. The post-acceleration space which remains free of discharges is accelerated to several kV. The spacer frame has a rough surface at least on its inside.

14 Claims, 3 Drawing Figures

GAS-DISCHARGE DISPLAY APPARATUS WITH A SPACER FRAME AND METHOD FOR FABRICATING THIS FRAME

BACKGROUND OF THE INVENTION

1. Field of the Invention

The invention relates to a gas-discharge display device constructed of:

(a) a gas-tight envelope filled with a gas with two mutually parallel wall plates (back plate, front plate), arranged one behind the other in the direction of view;

(b) a regularly perforated control structure contained in the envelope which subdivides the interior of the envelope into a rear and a front space (gas discharge space, post-acceleration space) and includes several electrode planes extending parallel to the plates;

(c) at least one cathode (plasma cathode) and at least one anode (plasma anode) in the gas discharge space;

(d) the front plate carrying on its back side a cathodoluminescent layer as well as an electrically conducting layer (post-acceleration anode);

(e) at least one conductor (post-acceleration cathode) in the frontmost electrode plane of the control structure, which cathode is spaced from the post-acceleration anode by a spacer frame;

(f) a gas discharge burning at least temporarily during operation between each plasma cathode and the corresponding plasma anode;

(g) electrons from this discharge pulling through selectively opened holes of the control structure into the post-acceleration space; and (h) accelerating the voltage to several kV in the post-acceleration space which remains free of discharges.

2. Description of the Prior Art

A plasma panel is described in German Published Non-Prosecuted Application DE-OS No. 29 52 528 and the equivalent U.S. Pat. No. 4,362,967 of Dec. 7, 1982. In the known display, a gas discharge furnishes electrons which are sent through selected holes of a control matrix into a post-acceleration space, absorb several kV of energy there and finally generate light dots on a phosphorous layer. In spite of the high voltage applied, the post-acceleration path is free of plasma for the following reason: In any gas, the firing voltage $V_z$ depends on the product of the gas pressure p and the electrode distance d such that $V_z$ first drops steeply with increasing p . d, then traverses a minimum and subsequently rises again slowly ("Paschen's law"). This means that in a given gas with given voltage and pressure values, a discharge is prevented if the operating point lies far enough in the left branch of the firing curve, i.e. d has sufficiently small values.

In practice, however, the post-acceleration space is by far not as high-voltage-proof as would properly be expected from the firing voltage curve. When the voltage is increased, breakdowns are observed in the vicinity of the frame which spread relatively fast and can cause considerable damage to the conductor structures.

As a result, attempts have been made relatively early to improve the insulation capabilities of the spacer frame. Thus, it is recommended in German Published Non-Prosecuted Application DE-OS No. 26 15 681 to give to the frame a profile with equidistant slots. Starting from this, the Offenlegungsschrift DE-OS No. 29 52 528, cited at the outset, lets the frame jut out toward the center of the cell relative to its sealing seams applied on the front and back side, and to keep its inside free of sealing material. With these frame variants, which have a relatively long leakage path in common, a post-acceleration voltage of, nevertheless, 4 kV can be applied (gas filling: He, p: 2.5 mbar, d: 1.7 mm). However, this value does not allow sufficient contrast and brightness values in all cases. If maximum information quantities, for instance color video signals, must be processed, the electrons should have an impingement energy of at least 6 kV.

SUMMARY OF THE INVENTION

An object of the invention is to provide in a panel of the type mentioned at the outset, a spacer frame which insulates better than the spacer frame used heretofore.

With the foregoing and other objects in view, there is provided in accordance with the invention a gas discharge display device comprising:

(a) a vacuum-tight, gas filled envelope closed on one side by a front plate and on a side opposite thereto by a back plate parallel to the front plate, said plates disposed one behind the other;

(b) a control unit having regularly spaced passage openings dividing the interior of the envelope into a back space as a gas discharge space and a front space as a post-acceleration space, said control unit having a plurality of electrode planes extending parallel to the plates;

(c) at least one plasma cathode and at least one plasma anode in the gas discharge space, wherein in operation a gas discharge burns at least temporarily between each plasma cathode and a corresponding plasma anode with electrons from the discharge pulled through openings of the control unit into the post-acceleration space;

(d) said front plate carrying on its backside a cathodoluminescent layer as well as an electrically conducting layer as a post-acceleration anode;

(e) at least one conductor as a post-acceleration cathode in the foremost electrode plane of the control unit, said post-acceleration cathode spaced from the post-acceleration anode by a spacer frame; which extends around the post-acceleration space between the front plate and the back plate;

(f) means for accelerating the voltage in the post-acceleration space which remains free of discharges to several kV; the combination therewith of (g) said spacer frame having a rough surface at least on its inside. Said spacer frame reducing breakdown caused by high voltage, wherein the rough surface has an average roughness depth $R_z$ with the range 1 $\mu m \leqq R_z \leqq 100$ $\mu m$. Preferably, the rough surface has an average roughness depth $R_z$ within the range 4 $\mu m \leqq R_z \leqq 40$ $\mu m$. Desirably, the rough surface has the shape of a shallow tray. Preferably, the rough surface has a maximum roughness depth $R_{max} \leqq 250$ $\mu m$.

In accordance with the invention there is provided a gas discharge display device comprising (a) a vacuum-tight, gas filled envelope closed on one side by a front plate and on a side opposite thereto by a back plate parallel to the front plate, said plates disposed one behind the other;

(b) a control unit having regularly spaced passage openings dividing the interior of the envelope into a back space as a gas discharge space and a front space as a post-acceleration space, said control uni having a plurality of electrode planes extending parallel to the plates;

(c) at least one plasma cathode and at least one plasma anode in the gas discharge space, wherein in operation a gas discharge burns at least temporarily between each plasma cathode and a corresponding plasma anode with electrons from the discharge pulled through openings of the control unit into the post-acceleration space;

(d) said front plate carrying on its backside a cathodoluminescent layer as well as an electrically conducting layer as a post-acceleration anode;

(e) at least one conductor as a post-acceleration cathode in the foremost electrode plane of the control unit, said post-acceleration cathode spaced from the post-acceleration anode by a spacer frame which extends around the post-acceleration space between the front plate and the back plate;

(f) means for accelerating the voltage in the post-acceleration space which remains free of discharge to several kV; the combination therewith of (g) said spacer frame having a rough surface at least on its inside, said spacer frame reducing breakdown caused by high voltage, wherein the rough surface is coated with islands of an electrically conducting material which are electrically insulated from each other.

Other features which are considered as characteristic for the invention are set forth in the appended claims.

Although the invention is illustrated and described herein as embodied in a gas-discharge display apparatus with a spacer frame and method for fabricating this frame, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
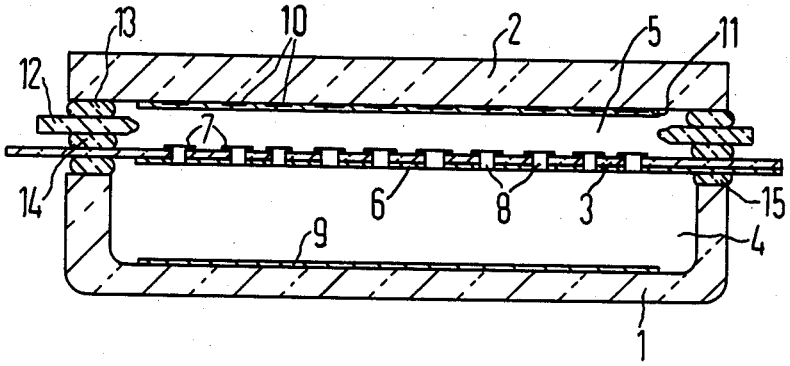
FIG. 1 is a sectional view diagrammatically illustrating a gas discharge display device in accordance with the invention containing a vacuum-tight, gas-filled envelope which has a spacer frame spacing a control plate in the envelope from the front plate of the envelope.

According to the invention, this problem of overcoming the difficulties concerning breakdowns, etc., discussed above, is solved by the provision that the frame has, at least on its inside a rough surface. "Rough" here means a shape deviation of at least the fourth order (DIN 4760).

The solution starts out from the following observation. The spacer frames used heretofore consisted of a glass plate, from which a window had been cut out mechanically. Such a treatment always leaves fracture edges and conchoidal fractures on the inside of the frame from which the disturbing (sliding and point) discharges start in the operation of the display, and this occurs also if path-increasing projections had been worked into the frame. A frame designed in accordance with the invention is free of such burs. Its involved surface has instead a specific microstructure which results in a long effective insulation path but does not contain formations which could trigger a breakdown. This behavior has complex causes which are not yet completely clear at this time; it is a fact, however, that a conventional frame after having been matted as proposed, allows very considerably higher voltages.

The preferred method of treating the surface of the frame is to roughen it by a blasting technique, for instance by bombarding it with $Al_2O_3$ or glass beads. Advantageously this blasting is carried out in two steps, initially with beads of larger diameter and subsequently with smaller beads. A blasted surface is clean; no further treatment is needed to free it of residues which, as is well known, affect the breakdown strength sensitivity.

The best results are obtained if the rough frame surface is also provided with a conducting material in an amount insufficient to produce a continuous layer. Such coating the area mass of which is typically $\leqq 8$ mg-cm$^{-2}$ and preferably $\leqq 5$ $\mu$mg.cm$^{-2}$, is obtained if the surface is blasted with balls which are already coated with the material in question, for instance Cu. The fact that such a coating promotes the short-circuit resistance, is presumably due to the fact that it linearizes the potential gradient along the surface of the frame in the manner of an extremely high-resistance surface resistor and thereby prevents local field strength peaks.

Comparative measurements have shown that by the frame matting provided by the invention, the voltage breakdown strength can be improved without difficulty by a factor greater than 3. This amazing result opens up a wide latitude for optimization for a number of important parameters. Thus, the high voltage can first be adjusted to a particularly high value. In this case, the required display qualities are obtained with minimal electron currents, a mode of operation which saves the fluorescent material layer and keep it operable for a long time. In addition, one may work with a moderately increased high voltage and higher gas pressure. This combination of measures is attractive because part of the gas is consumed after several hundred operating hours and therefore, the initial pressure should be higher than the operating value proper. Otherwise one has a relatively free hand in the choice of the gas composition and the spacing between the post-acceleration electrodes.

The invention will now be explained with reference to a preferred embodiment example, and to the attached drawings.

The display shown contains a vacuum-tight, gas-filled envelope with a tray-like back part 1 and a front plate 2 extending parallel to the bottom of the tray. The interior of the envelope is divided by a control plate 3 which is parallel to the front plate, into a rear gas discharge space 4 and a front post-acceleration space 5. The control plate 3 carries on its backside line conductor 6 and on its front side, column conductors 7 extending perpendicularly to the line conductors 6. All conductors can be addressed individually; together they form a control matrix. In each matrix element, the control structure composed of the control plate 3 and the matrix conductors 6 and 7 is provided with a passage opening 8. The bottom of the tray carries on its front side several mutually parallel plasma cathode strips 9 and the front plate 1 is provided on its back side with phosphor strips 10 parallel to the column conductors 7, as well as with a continuous post-accelerating anode 11. The control plate 3 is spaced from the front plate 2 by a spacer frame 12 which is connected on both sides by a glass solder seam 13, 14 to the control plate 3 or the front plate 2 in a vacuum-tight manner. The connection between the control plate 3 and the tray 1 is made via a glass solder seam 15.

The frame 12 extends inward beyond the two glass solder seams 13, 14 terminating with a rounded profile with a rough surface. This frame can be produced efficiently in the following manner. First, a window is cut from a soft-glass plate about 1.1 mm thick by means of a diamond cutter. Then, the inside in the frame obtained in this manner is rounded by means of a blasting technique, is matted and coated with copper. To this end, the frame is first blasted for several seconds with $Al_2O_3$ beads up to 120 μm thick, and subsequently lapped with a jet of glass beads up to 60 μm thick. The glass beads are coated with copper. The treated surface is subsequently rinsed; a special cleaning process is not required.

Figure 2:
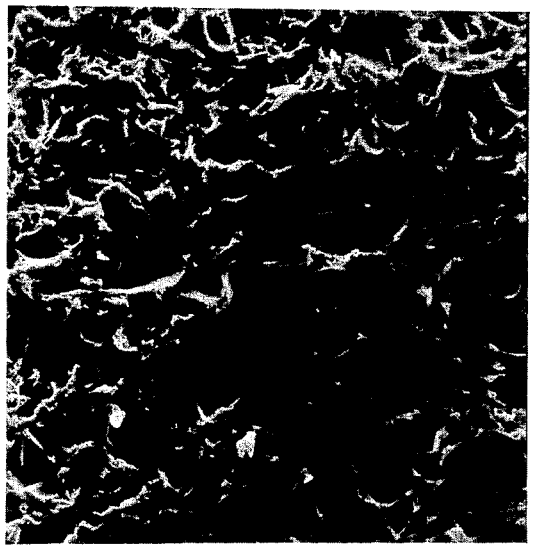
FIG. 2, enlarged, shows the rough surface of the spacer frame of FIG. 1.
Figure 3:
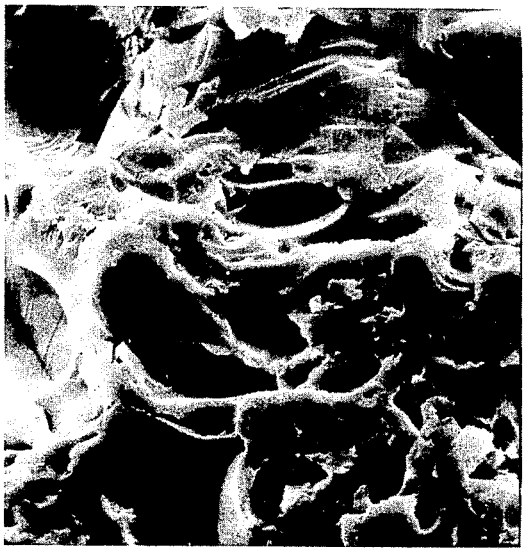
FIG. 3 shows a detail of FIG. 2, again magnified.

FIGS. 2 and 3 convey an impression of the structure of the rough frame surface. They stem from scanning electromicroscope pictures of a gold-metallized surface and show the surface magnified 400 and 2000 times, respectively. From these figures it can be estimated that the roughness depth of this shallow-depression surface mountain area is on the average between 10 μm and 15 μm and reaches maximally 40 μm (DIN 4768, Sheet 1). All other parts of the picture screen are known per se. For further details of the manufacture and operation, reference is made to "Elektronik", volume 14 (1982), page 79.

The invention is not limited to only the embodiment example shown. In the present context the important point is to make the post-acceleration path short-circuit proof. To that extent, the gas discharge could also be generated in another form, for instance, as a stationary transverse plasma, and/or the electrodes could be organized differently, for instance, by letting the same conductors serve as plasma cathodes and as line conductors or to work with a post-deflection in the high-voltage space. Apart from that, other frame materials and/or other matting methods may be employed, for instance, certain ceramics and special etching techniques. Even though other spacing elements are provided in addition to the spacer frame the surfaces of these additional bodies are roughened in the same manner.

There is claimed:

1. Gas discharge display device comprising:

(a) a vacuum-tight, gas filled envelope closed on one side by a front plate and on a side opposite thereto by a back plate parallel to the front plate, said plates disposed one behind the other;

(b) a control unit having regularly spaced passage openings dividing the interior of the envelope into a back space as a gas discharge space and a front space as a post-acceleration space, said control unit having a plurality of electrode planes extending parallel to the plates;

(c) at least one plasma cathode and at least one plasma anode in the gas discharge space, wherein in operation a gas discharge burns at least temporarily between each plasma cathode and a corresponding plasma anode with electrons from the discharge pulled through openings of the control unit into the post-acceleration space;

(d) said front plate carrying on its backside a cathodoluminescent layer as well as an electrically conducting layer as a post-acceleration anode;

(e) at least one conductor as a post-acceleration cathode in the foremost electrode plane of the control unit, said post-acceleration cathode spaced from the post-acceleration anode by a spacer frame which extends around the post-acceleration space between the front plate and the back plate;

(f) means for accelerating the voltage in the post-acceleration space which remains free of discharge to several kV; the combination therewith of (g) said spacer frame having a rough surface at least on its inside, said spacer frame reducing breakdown caused by high voltage, wherein the rough surface has an average roughness depth $R_z$ within the range $1\mu m \leqq R_z \leqq 100\mu m$.

2. Display device according to claim 1, wherein the rough surface has an average roughness depth $R_z$ within the range $4\ \mu m \leqq R_z \leqq 40\ \mu m$.

3. Display device according to claim 1, wherein the rough surface has an average roughness depth $R_z$ within the range $1\ \mu m \leqq R_z \leqq 100\ \mu m$ and has the shape of a shallow tray.

4. Display device according to claim 1, wherein the rough surface has a maximum roughness depth $R_{max} \leqq 250\ \mu m$.

5. Gas discharge display device comprising:

(a) a vacuum-tight, gas filled envelope closed on one side by a front plate and on a side opposite thereto by a back plate parallel to the front plate, said plates disposed one behind the other;

(b) a control unit having regularly spaced passage openings dividing the interior of the envelope into a back space as a gas discharge space and a front space as a post-acceleration space, said control unit having a plurality of electrode planes extending parallel to the plates;

(c) at least one plasma cathode and at least one plasma anode in the gas discharge space, wherein in operation a gas discharge burns at least temporarily between each plasma cathode and a corresponding plasma anode with electrons from the discharge pulled through openings of the control unit into the post-acceleration space;

(d) said front plate carrying on its backside a cathodoluminescent layer as well as an electrically conducting layer as a post-acceleration anode;

(e) at least one conductor as a post-acceleration cathode in the foremost electrode plane of the control unit, said post-acceleration cathode spaced from the post-acceleration anode by a spacer frame which extends around the post-acceleration space between the front plate and the back plate;

(f) means for accelerating the voltage in the post-acceleration space which remains free of discharge to several kV; the combination therewith of (g) said spacer frame having a rough surface at least on its inside, said spacer frame reducing breakdown caused by high voltage, wherein the rough surface is coated with islands of an electrically conducting material which are electrically insulated from each other.

6. Display device according to claim 1, wherein the rough surface is coated with islands of an electrically conducting material which are electrically insulated from each other.

7. Display device according to claim 4, wherein the rough surface is coated with islands of an electrically conducting material which are electrically insulated from each other.

8. Display device according to claim 5, wherein the material coating the rough surface has an average layer thickness of about $d \leqq 10^{-3}$ μm.

9. Display device according to claim 5, wherein the material coating the rough surface has an average layer thickness of about $d \leqq 6.10^{-4}$ μm.

10. Display device according to claim 5, wherein the material coating the rough surface has an area mass $b \leqq 0.8$ μg.cm$^{-2}$.

11. Display device according to claim 5, wherein the material coating the rough surface has an area mass $b \leqq 0.5$ μg.cm$^{-2}$.

12. Display device according to claim 5, wherein the electrically conducting material is copper.

13. Display device according to claim 1, wherein the spacer frame projects into the post-acceleration space, wherein the transitions between the inside of the frame and the two end faces of the frame are rounded and wherein the frame surface is rough also in the rounded regions.

14. Display device according to claim 1, wherein the spacer frame consists of a soft glass with a thermal coefficient of expansion $\alpha \leqq 85.10^{-70}K^{-1}$.

* * * * *